US007137206B2

(12) United States Patent
Lira-Núñez

(10) Patent No.: US 7,137,206 B2
(45) Date of Patent: Nov. 21, 2006

(54) WRITING GUIDE

(75) Inventor: Carmen Lira-Núñez, St. Cloud, MN (US)

(73) Assignee: The Antioch Company, St. Cloud, MN (US)

( * ) Notice: Subject to any disclaimer, the term of this patent is extended or adjusted under 35 U.S.C. 154(b) by 0 days.

(21) Appl. No.: 11/040,460

(22) Filed: Jan. 19, 2005

(65) Prior Publication Data

US 2006/0156557 A1 Jul. 20, 2006

(51) Int. Cl.
*B43L 13/02* (2006.01)

(52) U.S. Cl. ..... 33/41.2; 33/18.2; 33/566; 33/492

(58) Field of Classification Search ..... 33/18.2, 33/41.1, 41.2, 41.4, 484–485, 492, 562, 566; 434/117, 166
See application file for complete search history.

(56) References Cited

U.S. PATENT DOCUMENTS

| | | | | | |
|---|---|---|---|---|---|
| 16,711 | A * | 3/1857 | Byron | 33/41.4 |
| 125,763 | A * | 4/1872 | Soehner | 33/41.1 |
| 205,795 | A * | 7/1878 | Green | 33/566 |
| 708,355 | A * | 9/1902 | Hartley | 33/485 |
| 883,009 | A * | 3/1908 | Gee | 33/41.4 |
| 965,945 | A * | 8/1910 | Roman | 33/566 |
| 2,267,497 | A * | 12/1941 | Farrow | 33/489 |
| 2,471,193 | A * | 5/1949 | Brower | 33/27.03 |
| 2,507,056 | A * | 5/1950 | Smith | 33/485 |
| 3,025,549 | A * | 3/1962 | Griffin et al. | 33/41.1 |
| 3,934,352 | A * | 1/1976 | Quenot | 33/493 |
| D266,857 | S | 11/1982 | Greenlees | |
| 4,840,273 | A * | 6/1989 | Zavacki | 206/372 |
| 5,337,484 | A | 8/1994 | Cardon | |
| 6,349,479 | B1 * | 2/2002 | Bottega | 33/481 |
| 6,418,631 | B1 * | 7/2002 | Ramsthaler | 33/41.4 |
| 6,536,126 | B1 * | 3/2003 | Wilson | 33/477 |

* cited by examiner

*Primary Examiner*—Yaritza Guadalupe-McCall
(74) *Attorney, Agent, or Firm*—Gray, Plant, Mooty, Mooty & Bennett, PA; Peter Forrest

(57) ABSTRACT

A guide for freehand writing or similar graphics comprises a writing support that eliminates the task of drawing lines and then erasing them in order to write on a straight line. The writing support forms a forgiving visual line that recedes when writing letters with descenders such as g, j, p, q, and y. In the preferred embodiment, the writing support is a plurality of loops of flexible material extending from a base.

56 Claims, 4 Drawing Sheets

WRITING GUIDE

TECHNICAL FIELD

This invention concerns guides for writing and similar graphics that may be applied freehand to writing and craft surfaces.

BACKGROUND

One type of high-quality loose-leaf album comprises a pair of covers enfolding a plurality of replaceable leaves for photographs or similar memorabilia, the covers and leaves being laced together by straps which lace through hinge elements projecting from the leaves, and also through slots in holders attached to the inside of the covers. The cover holders frictionally hold the ends of the straps. See, for example, U.S. Pat. No. 5,848,851 (Gunasekera). Such albums are extremely popular in the craft and hobby known as scrapbooking.

One particularly popular aspect of scrapbooking is to add comments or titles to album pages, e.g. to indicate the theme of the photographs on the page. Such writing is often done in freehand (manuscript) as opposed to use of stamps, stickers, and the like.

SUMMARY OF THE INVENTION

The invention is a guide for freehand writing or similar graphics. It comprises a flexible or conformable writing support that eliminates the task of drawing lines and then erasing them. The support forms a forgiving visual line that recedes when writing letters with descenders (such as g, j, p, q, & y). This allows the user to to follow an even alignment (typically, but not necessarily, horizontal) during freehand writing. In the preferred embodiment, the writing support is a plurality of loops of flexible material.

BRIEF DESCRIPTION OF THE DRAWINGS

The accompanying drawings show a particular embodiment of the invention as an example, and are not intended to limit the scope of the invention. In particular, the proportions and/or dimensions that may be suggested by the figures are preferred but not required except as specifically set forth in the claims.

DETAILED DESCRIPTION

Figure 1:
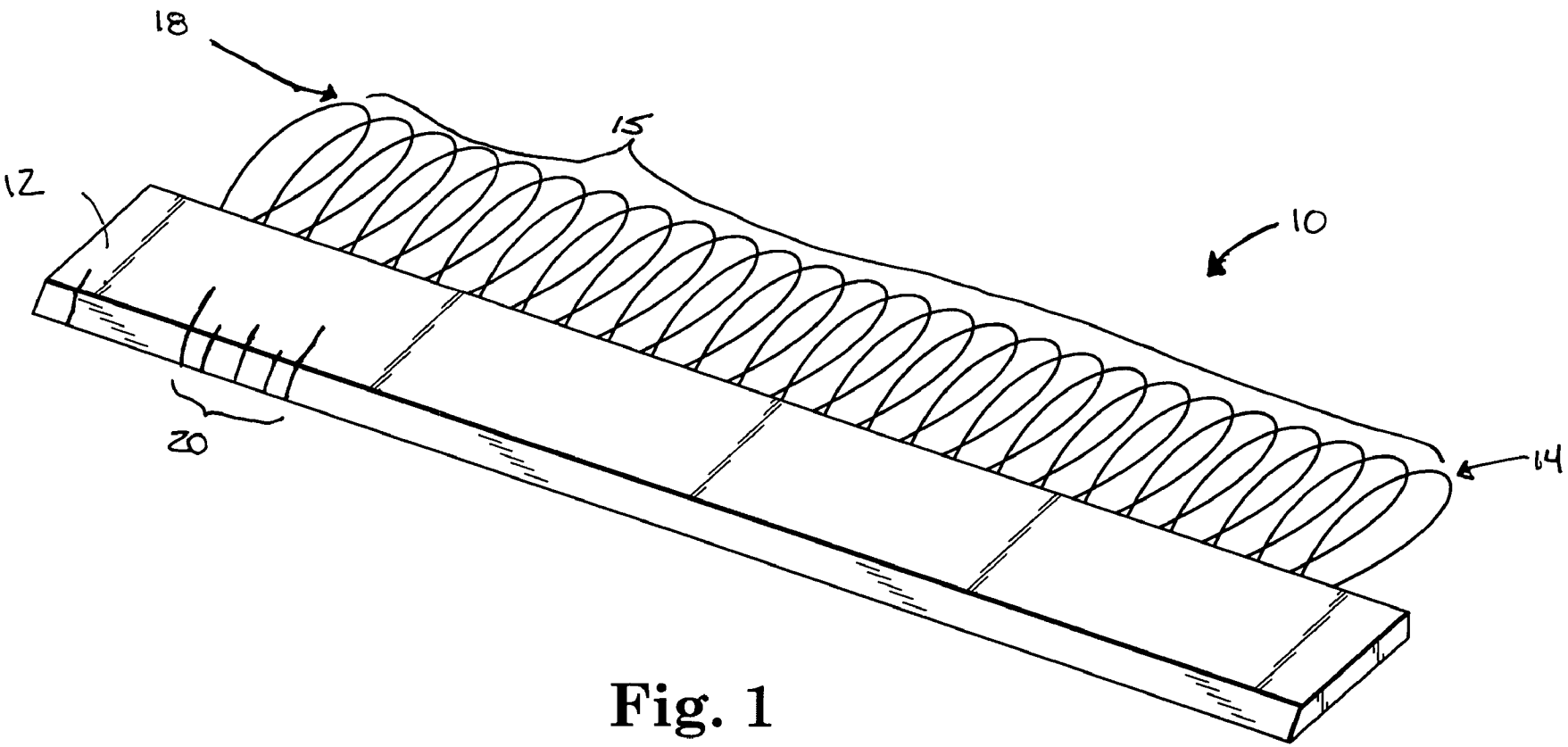
FIG. 1 is a perspective view of a preferred embodiment of the invention.

FIGS. 1–7 illustrate the most preferred embodiment of the invention, although the various aspects of the invention described below are not critical to the scope of the invention, except as specifically noted.

The invention is a writing guide 10. Writing guide 10 comprises a base 12 and a writing support 14. The invention is designed to be placed on a writing surface 16 such that an upper edge 18 of the writing support 14 lies where the writing or graphic is to be located. Any convenient writing implement (not part of the invention) may be used. No frame or other supporting mechanism is necessary to align writing guide 10 in position.

Figure 2:
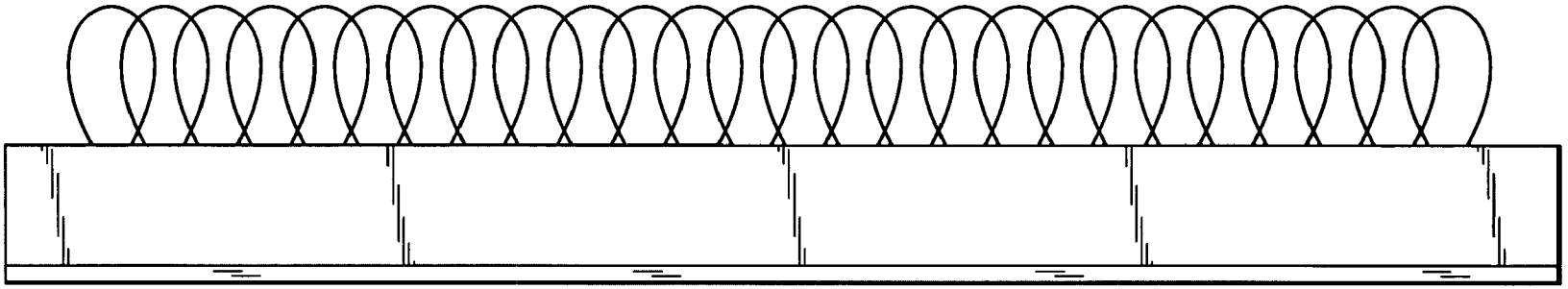
FIG. 2 is a front elevational view of the preferred embodiment of FIG. 1.
Figure 3:
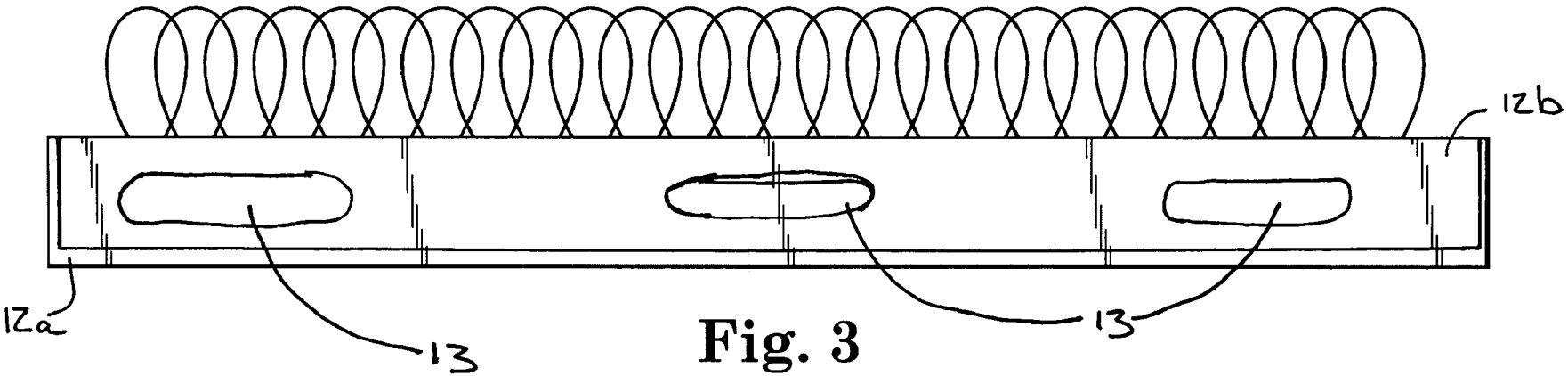
FIG. 3 is a rear elevational view of the preferred embodiment of FIG. 1.
Figure 4:
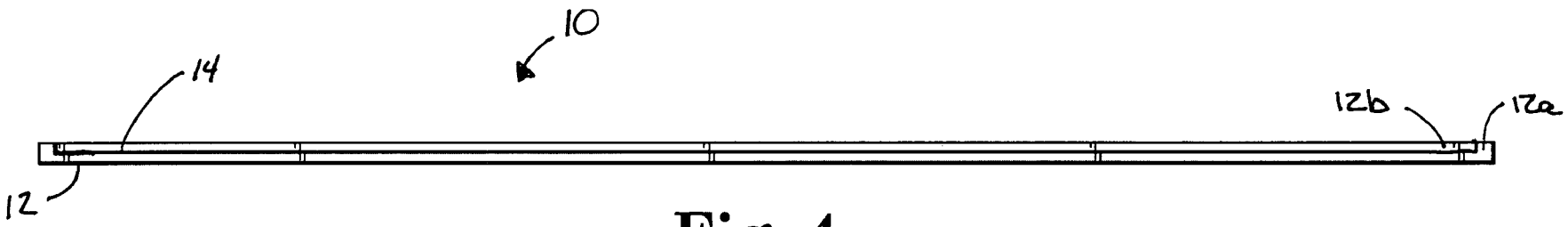
FIG. 4 is a top plan view of the preferred embodiment of FIG. 1.
Figure 5:
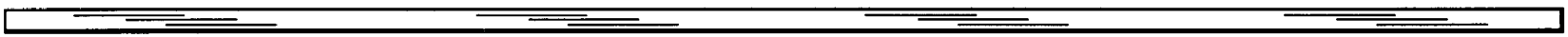
FIG. 5 is a bottom plan view of the preferred embodiment of FIG. 1.
Figure 6:
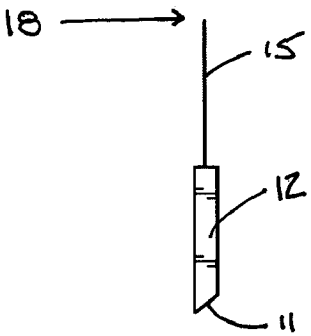
FIG. 6 is a left side view of the preferred embodiment of FIG. 1. Due to symmetry, the right side view is not shown.
Figure 7:
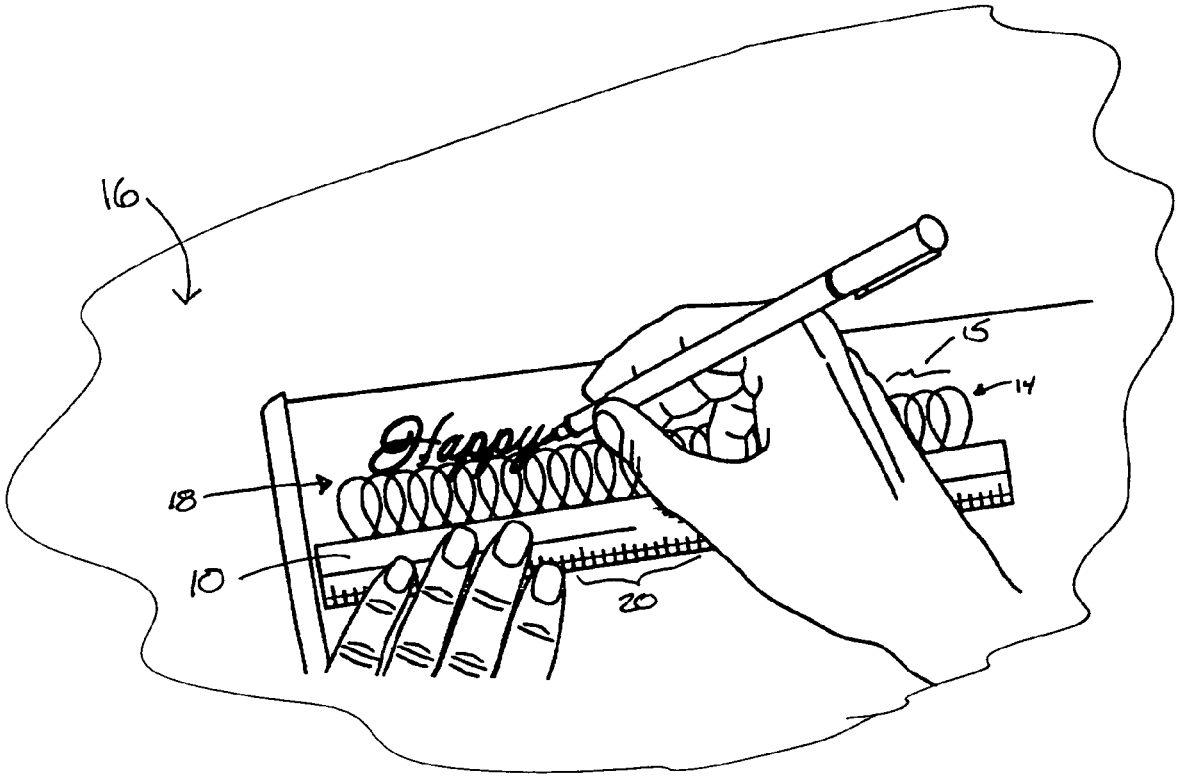
FIG. 7 is a perspective view of the preferred embodiment of FIGS. 1–6 in use.

Base 12 is a generally rectangular piece having length extending in the transverse direction (side-to-side as illustrated in FIG. 2), width perpendicular to the length (i.e., up-and-down in FIG. 2), and thickness perpendicular to both the length and the width (i.e. perpendicular to the plane of the writing surface, and as shown most clearly in FIGS. 4–6). The exact numerical value of each of these three dimensions is not critical to the function of the invention, provided that they are in a range that enables the invention to operate according to the principles described below. In the most preferred embodiment, the length is approximately 21.0 cm, the width is approximately 1.9 cm, and the thickness is approximately 0.2 cm. The base preferably has a flat back surface (FIG. 3) to accommodate placement of the guide on a flat, smooth writing surface (FIG. 7).

The identity of the material of base 12 is not critical to the scope of the invention, but in the most preferred embodiment, it is a cured polymer such as polyethylene. Other suitable molded, cured polymers (or polymer mixes) may be used, as could wood, metal, ceramic or other materials.

It is preferred, but not required, that base 12 include measurement indicia 20 such as marks, numbers and the like common in the graphic and craft arts. Such indicia may be directly incorporated into the material of the base 12 (e.g., by molding, inlay, embossing, carving and the like), or added to the base 12 by direct printing, use of a separately printed and subsequently adhered label, and so on. In the most preferred embodiment illustrated in the Figures, the indicia 20 are conventional ruler markings (English or Metric units) that have been molded into the base 12. The molded indicia 20 should rise above the surface of the base 12 so that they may easily be felt with the fingertips, but they could be recessed into the base 12 if so desired. When measurement indicia are used, it is preferred to bevel the bottom edge 11 of the base 12 (FIG. 6) where the indicia are located, for greater accuracy in use of the invention as a ruler.

In the most preferred embodiment illustrated in the Figures, the writing support 14 comprises a plurality of individual, overlapping, pliable loops of material such as thread, wire, fishing line, or any other similarly shaped material. The most preferred material is monofilament nylon line. The loops 15 extend from the top side of base 12, to extend generally parallel to the writing surface, by a constant amount (e.g. 19 mm). Their individual curved surfaces collectively suggest a line tangent to each loop, at the location of upper edge 18 of writing support 14. The actual tangent points of each of loops 15 is slightly elevated above the writing surface due to the location of loops 15 being between the front and back surfaces of base 12. Thus, the flexibility of the writing support 14 forms a forgiving visual line that recedes when writing letters with descenders such as g, j, p, q, and y, especially when cursive writing is performed. The number of loops is not a limitation on the scope of the invention, nor is it required that adjacent loops overlap as illustrated. In the most preferred embodiment, a relatively large number of loops (approximately three per inch) is desired to adequately define upper edge 18 over the entire extent of the writing guide, but the number, size, shape, and construction of the loops are each parameters that may be varied without departing from the scope of the invention.

Loops 15 may be attached to base 12 in any convenient manner as determined by the selection of materials for each component. In the most preferred embodiment, base 12 is a two-piece construction in which the loops are held between front and back pieces 12*a*, 12*b* (FIGS. 3 and 4) that mate together and have themselves been permanently attached to each other by any convenient technique, such as adhesion, snap-fit, ultrasonic welding, and the like. To ensure a snug fit, channels of compatible dimensions may be formed in one or both of the pieces to accommodate the thickness of the material forming loops 15. If desired, such channels may be joined together internally within base 12, so that the plurality of loops 15 is formed from one or more extended lengths of loop material that has been repeatedly wound through the joined channels (not shown). Another alternative is to provide for a gap between the front and back pieces that runs along substantially the entire length of base 12, and from which loops 15 extend, as opposed to individual openings for each side of each loop 15. However, in general, the details of the internal construction of writing guide 10 are not critical to the scope of the invention, provided that the loops 15 are held securely in place to serve their intended purpose.

In commercial versions of the preferred embodiment, it is separately preferred to (1) provide the invention with at least one (most preferably three) resilient feet 13 mounted on the back side of the invention (FIG. 3), to keep it stationary while in use; and (2) provide a protective cover of any suitable design (not shown) to protect the loops when not in use.

Having described the preferred embodiment of the invention above, it is now possible to describe the full breadth of the invention in more general terms. The invention is a writing guide that comprises a base, and a flexible or conformable writing support attached to the base in any convenient manner. It should also be appreciated that the upper edge of the writing surface is preferably, but not necessarily, straight; embodiments of the invention having a generally curved upper edge to the writing support are within the scope of the invention, and the curvature of the upper edge could be concave, convex, or a combination of the two (e.g., sinusoidal).

I claim:

1. A writing guide having a writing support that extends from a base and comprises a plurality of loops that collectively suggest a line tangent to each loop, in which adjacent loops overlap.

2. The guide of claim 1, in which the loops comprise a flexible material.

3. The guide of claim 1, in which the base is generally rectangular.

4. The guide of claim 1, in which the base is one of a polymer, wood, metal, or ceramic.

5. The guide of claim 1, in which the base further comprises measurement indicia.

6. The guide of claim 1, in which the base further comprises indicia directly incorporated into the material of the base.

7. The guide of claim 1, in which the base further comprises printed indicia added to the base.

8. The guide of claim 1, in which the base further comprises ruler markings molded into the base.

9. The guide of claim 1, in which a lower edge of the base is beveled.

10. The guide of claim 1, further comprising at least one resilient foot mounted on the back side of the base.

11. The guide of claim 1, in which the writing support comprises a plurality of loops formed of a material selected from the group consisting of thread, wire, and fishing line.

12. The guide of claim 1, in combination with a cover to protect the writing support when not in use.

13. A writing guide having a writing support that extends from a base in only a direction substantively parallel to a writing surface, the writing support comprising a plurality of loops that collectively suggest a line in the plane of the writing surface that is tangent to each loop, in which adjacent loops overlap.

14. The guide of claim 13, in which the loops comprise a flexible material.

15. The guide of claim 13, in which the base is generally rectangular.

16. The guide of claim 13, in which the base is one of a polymer, wood, metal, or ceramic.

17. The guide of claim 13, in which the base further comprises measurement indicia.

18. The guide of claim 13, in which the base further comprises indicia directly incorporated into the material of the base.

19. The guide of claim 13, in which the base further comprises printed indicia added to the base.

20. The guide of claim 13, in which the base further comprises ruler markings molded into the base.

21. The guide of claim 13, in which a lower edge of the base is beveled.

22. The guide of claim 13, further comprising at least one resilient foot mounted on the back side of the base.

23. The guide of claim 13, in which the writing support comprises a plurality of loops formed of a material selected from the group consisting of thread, wire, and fishing line.

24. The guide of claim 13, in combination with a cover to protect the writing support when not in use.

25. A writing guide having a writing support that extends from a base and comprises a plurality of loops that collectively suggest a line tangent to each loop, and further comprising at least one resilient foot mounted on the back side of the base, in which adjacent loops overlap.

26. The guide of claim 25, in which the loops comprise a flexible material.

27. The guide of claim 25, in which the base is generally rectangular.

28. The guide of claim 25, in which the base is one of a polymer, wood, metal, or ceramic.

29. The guide of claim 25, in which the base further comprises measurement indicia.

30. The guide of claim 25, in which the base further comprises indicia directly incorporated into the material of the base.

31. The guide of claim 25, in which the base further comprises printed indicia added to the base.

32. The guide of claim 25, in which the base further comprises ruler markings molded into the base.

33. The guide of claim 25, in which a lower edge of the base is beveled.

34. The guide of claim 25, in which the writing support comprises a plurality of loops formed of a material selected from the group consisting of thread, wire, and fishing line.

35. The guide of claim 25, in combination with a cover to protect the writing support when not in use.

36. A writing guide having a writing support that extends from a base and comprises a plurality of loops that collectively suggest a line tangent to each loop, in which the writing support comprises a plurality of loops formed of a material selected from the group consisting of thread, wire, and fishing line, in which adjacent loops overlap.

37. The guide of claim 36, in which the base is generally rectangular.

38. The guide of claim 36, in which the base is one of a polymer, wood, metal, or ceramic.

39. The guide of claim 36, in which the base further comprises measurement indicia.

40. The guide of claim 36, in which the base further comprises indicia directly incorporated into the material of the base.

41. The guide of claim 36, in which the base further comprises printed indicia added to the base.

42. The guide of claim 36, in which the base further comprises ruler markings molded into the base.

43. The guide of claim 36, in which a lower edge of the base is beveled.

44. The guide of claim 36, further comprising at least one resilient foot mounted on the back side of the base.

45. The guide of claim 36, in combination with a cover to protect the writing support when not in use.

46. A writing guide having a writing support that extends from a base and comprises a plurality of conformable loops that collectively suggest a line tangent to each loop, in which adjacent loops overlap.

47. The guide of claim 46, in which the base is generally rectangular.

48. The guide of claim 46, in which the base is one of a polymer, wood, metal, or ceramic.

49. The guide of claim 46, in which the base further comprises measurement indicia.

50. The guide of claim 46, in which the base further comprises indicia directly incorporated into the material of the base.

51. The guide of claim 46, in which the base further comprises printed indicia added to the base.

52. The guide of claim 46, in which the base further comprises ruler markings molded into the base.

53. The guide of claim 46, in which a lower edge of the base is beveled.

54. The guide of claim 46, further comprising at least one resilient foot mounted on the back side of the base.

55. The guide of claim 46, in which the writing support comprises a plurality of loops formed of a material selected from the group consisting of thread, wire, and fishing line.

56. The guide of claim 46, in combination with a cover to protect the writing support when not in use.

* * * * *